US005938063A

United States Patent [19]

Hoftman

[11] Patent Number: 5,938,063

[45] Date of Patent: Aug. 17, 1999

[54] HINGED, LATCHABLE BOX AS FOR MEDICAL SHARPS

[76] Inventor: Moshe Hoftman, 4839 Bond Ave., Calabasas, Calif. 92869

[21] Appl. No.: 08/885,652

[22] Filed: Jun. 30, 1997

[51] Int. Cl.[6] ..... B65D 45/16

[52] U.S. Cl. ..... 220/326; 206/366; 206/370; 220/260; 220/840

[58] Field of Search ..... 206/63.5, 366, 206/370, 438, 1.5; 220/326, 340, 338, 908–910, 260, 284, 335, 485, 840, 841, 843

[56] References Cited

U.S. PATENT DOCUMENTS

| | | | |
|---|---|---|---|
| D. 273,615 | 4/1984 | Maskrey . | |
| D. 376,647 | 12/1996 | Marsh et al. . | |
| 4,013,109 | 3/1977 | Sandel . | |
| 4,193,496 | 3/1980 | Barratt . | |
| 4,349,120 | 9/1982 | DiNardo | 220/338 |
| 4,376,629 | 3/1983 | Ulin et al. . | |
| 4,746,008 | 5/1988 | Heverly et al. | 220/338 |
| 4,809,874 | 3/1989 | Pehr | 220/338 |
| 4,886,165 | 12/1989 | Annett . | |
| 4,967,924 | 11/1990 | Murofushi et al. | 220/338 |
| 5,024,326 | 6/1991 | Sandel et al. . | |
| 5,154,345 | 10/1992 | Shillington . | |
| 5,181,609 | 1/1993 | Spielmann et al. . | |
| 5,193,678 | 3/1993 | Janocik et al. | 206/366 |
| 5,529,205 | 6/1996 | Corney et al. | 220/338 |
| 5,531,345 | 7/1996 | Nakamura et al. | 220/326 |
| 5,577,779 | 11/1996 | Dangel | 220/326 |
| 5,617,952 | 4/1997 | Kranendonk . | |
| 5,642,832 | 7/1997 | Favre | 220/260 |

*Primary Examiner*—Paul T. Sewell
*Assistant Examiner*—Luan K. Bui

[57] ABSTRACT

The present invention comprises an improved latch and hinge for an integrally molded box, preferably a sharps box. The combination of the latch and hinge provides a surprisingly secure, simple and inexpensive integrally molded box.

4 Claims, 5 Drawing Sheets

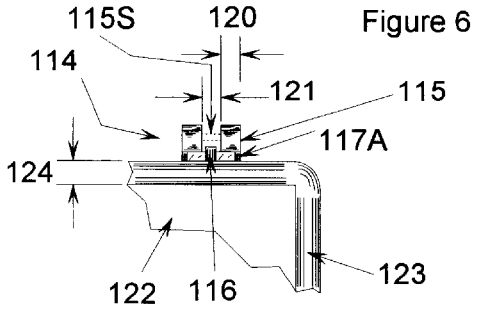
Figure 6
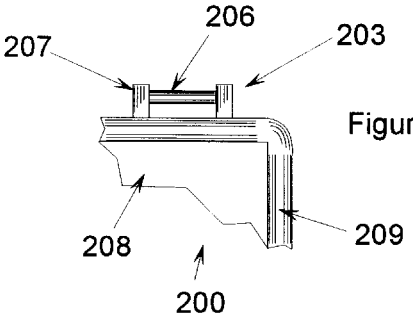
Figure 7
Figure 8
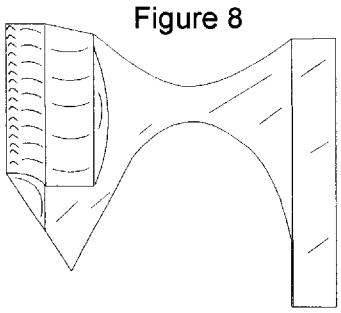
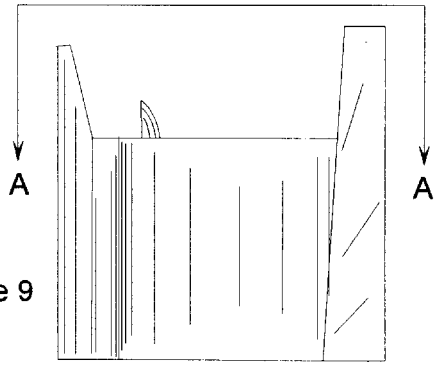
Figure 9
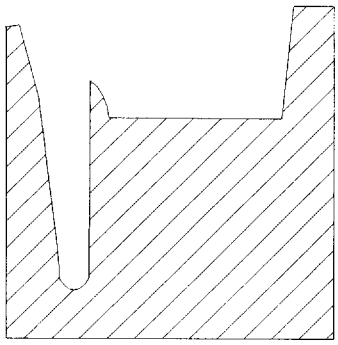
Figure 10
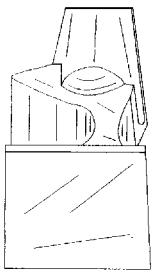
Figure 11

Figure 12
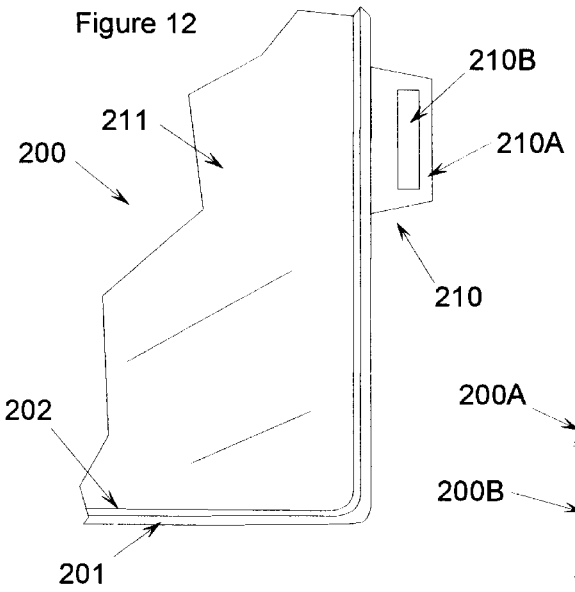
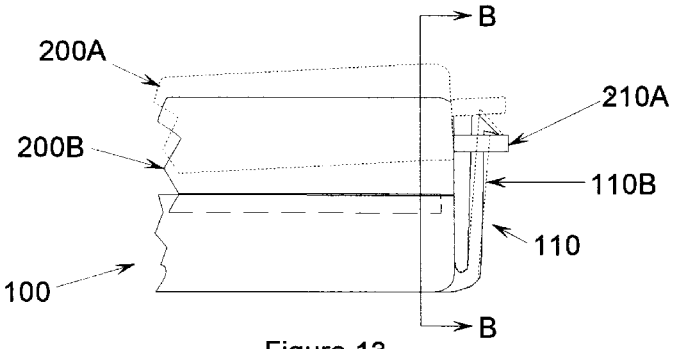
Figure 13
Figure 14
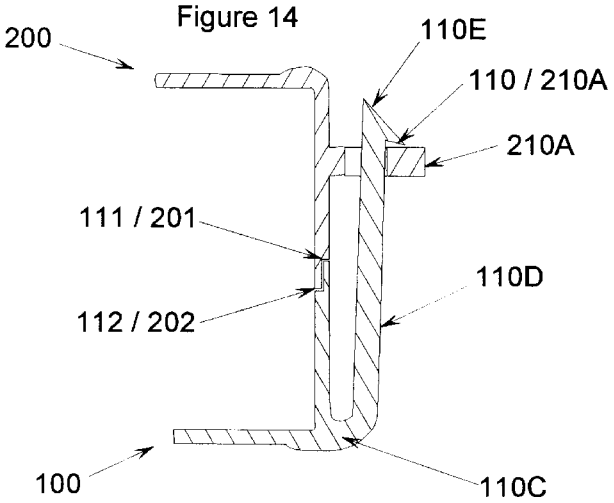
Figure 15
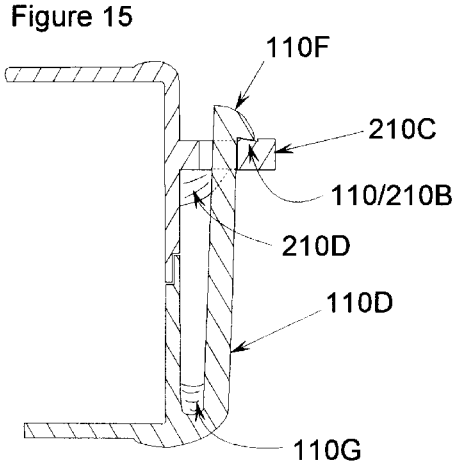

Figure 16
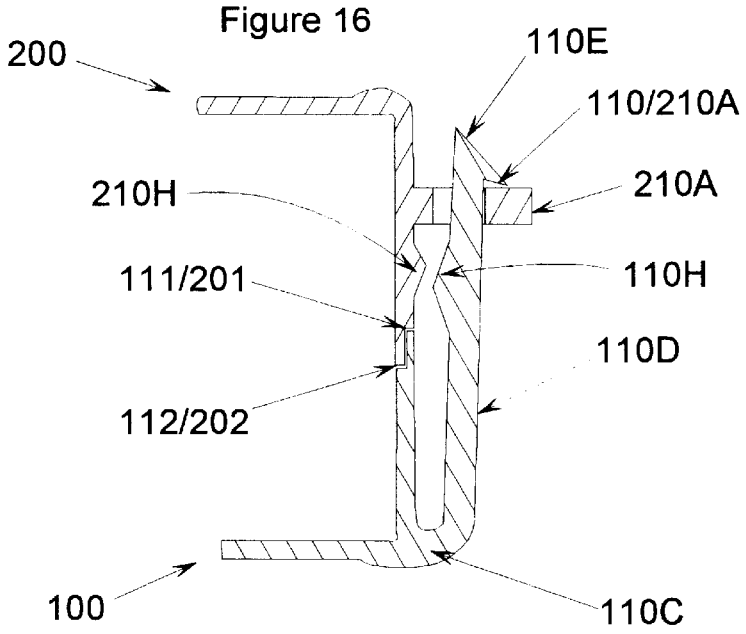
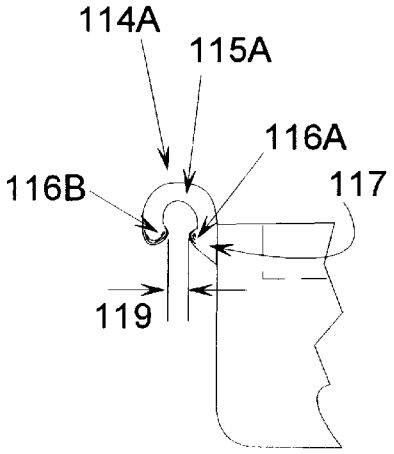
Figure 18
Figure 17
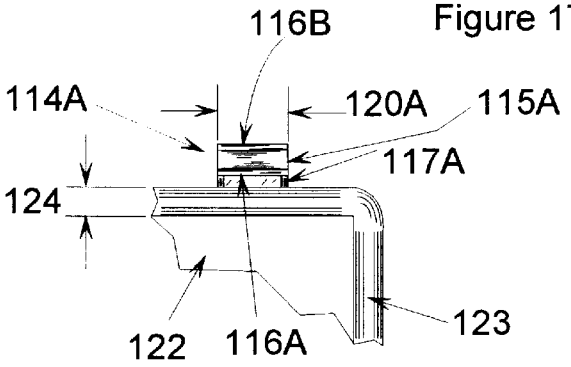

HINGED, LATCHABLE BOX AS FOR MEDICAL SHARPS

BACKGROUND OF THE INVENTION

The present invention relates to detachably hinged boxes, and more particularly to those boxes with two halves having integrally molded hinges which are easily detachable one from the other.

U.S. Pat. No. 4,373,629 (Ulin, et. al., February 1983) describes a container for storing "sharps", e.g., surgical needles or blades, comprising: (a) base means formed of a reusable and sterilizable material containing a source of magnetism; (b) collecting means for surgical needles or blades, said collecting means shaped to provide an interlocking fit with said base means; and (c) cover means with said collecting means to form an enclosure, said cover means capable of tight-fitting engagement with and placement over said collecting means to prevent said surgical needles or blades from escaping from said enclosure when said cover means is in tight-fitting engagement with said collecting means, said collecting means and said cover means attached to each other by hinge means, said collecting means being provided with locking means to lock said cover means with said collecting means when said cover means is in tight fitting engagement with said collecting means. Preferably, the base comprises two or more parallel magnetized ribs mounted on and protruding from a platform, which exist in tight-fitting engagement with conforming apertures in the collecting means, which ribs and apertures synergistically (1) provide a source of magnetism just adequate to attract all sharps when placed into the container and (2) secure the sharps between the collecting means and cover means when the locking means is locked.

U.S. Pat. No. 5,154,345 (Shillington, October 1992) describes a disposable container assembly for medical sharps and waste comprises the combination of a substantially rigid box-like lower housing defined by upstanding front, back, and side walls terminating with a top having an upwardly extending rectangular opening for providing access to the housing, and a semi-cylindrical top curving about a generally horizontal axis secured along one edge of said top by a hinge and secured along the other edge by locking tabs for permanent securement thereto, an elongated horizontally extending access opening in said top for receiving a disposable syringe or the like, and a pivotable closure for said opening pivotably mounted about said axis within the top and having a receptacle area normally exposed to said access opening in a first position for receiving a disposed article and a curved surface for covering the access opening upon pivoting from said first position to a second position for dumping the article into said housing. A snap hinge is disclosed although poorly represented.

U.S. Pat. No. 4,013,109 (Sandel, March 1977) describes a hinged sterilizable disposable container for magnetizable surgical instruments which has relatively large upper and lower portions connected by sides of a relatively narrower dimension. A non-deformable outer case is provided for retaining the instruments entirely within the case and precluding any tendencies for said instruments to protrude from the case. Magnetic means are provided which completely cover the interior portion of the case and retain any magnetizable instruments placed within the case.

U.S. Pat. No. 4,193,496 (Barratt, March 1980) describes An improved disposable receiver, formed by foldably nesting a shaped cover element into a correspondingly shaped tray element, for securely encasing sharp disposable surgical implements features a combination of reopenable retaining and locking means for retaining the receiver in the closed, nested position. In a preferred embodiment, the disposable receiver may be formed of transparent plastic material into symmetrical tray and cover portions separated by an integrally formed flexible hinge, and a number of integrally formed pressure fit snap locks are arrayed around the periphery of the receiver to provide readily reopenable closure retaining means. Additionally, the tray and cover portions are slightly pyramidally shaped to produce a receiver of high rigidity when in the closed, nested position.

U.S. Pat. No. 5,617,952 (Kranendonk, April 1997) describes A suture needle protector for holding needles during surgical operations includes a cover attached to a base by a hinge to allow selective opening and closing of the cover with respect to the base. The suture needle is held within the protector temporarily, such as during tying off of a suture knot. A flexible elastic strap may be attached to the base to allow the protector to be mounted on the finger of the surgeon where the protector is conveniently available at a known location. A magnetic plate may be mounted within the base to help draw a surgical needle to the base and hold it in place when the cover is open. The cover is releasably held to the base by mating hook and lip structures on the cover and base to provide a snap connection. When the surgeon wishes to open the cover, pulling the cover from the base disengages the snap connectors. Because the protector can be mounted on the finger of the surgeon, when the needle is held within the closed protector with the suture extending from the protector the surgeon can use the protector during tying off to pull on the suture.

U.S. Pat. No. 5,181,609 (Spielmann, et. al., January 1993) describes a disposable device for receiving and holding sharp implements such as surgical sharps or the like which includes a top member connected in spaced apart relationship to a bottom member and defining a substantially enclosed receiving area therebetween. The top member has an outer magnetic surface for receiving and retaining various sharp implements, while at least a portion of the receiving area also includes a magnetic surface adjacent the bottom member. A portion of the receiving area also houses a foam block or similar material for frictionally receiving and retaining additional sharp implements such as needles or the like, and the top member can be hinged for selectively providing unencumbered visual access to the contents of the normally enclosed receiving area. In the surgical context, the disposable device provides optimum positive retention and visual access for substantially all commonly utilized surgical sharps, with the enclosed receiving area providing a convenient and protected area for temporary storage of scalpels and the like which must be reused during any particular procedure.

U.S. Pat. No. 5,024,326 (Sandel, et. al., June 1991) describes A medical instrument holder and sharps disposal device is disclosed wherein a pair of plastic container body halves are provided to be manipulated between opened and closed positions by associated hinge means and a mechanical lock. A medical instrument rest in the form of a one piece molded plastic insert is provided on one of the body halves for positioning medical instruments thereon when the container is in its open position. A cushion of reticulated foam material is provided to receive and envelope the tips of sharps associated with the instruments laid upon the rest. Sharps removal means are provided for assisting in the release of medical instrument sharps from the associated medical instruments. A magnetic means is also provided within one of the container body halves for receiving and holding such removed sharps to facilitate the counting a subsequent disposal thereof within the container when a medical operation has been completed and the sharps and container are to be discarded.

U.S. Pat. No. 4,886,165 (Annett, December 1989) describes a disposable hinged box for surgical articles. The container has certain design features to facilitate accounting of small surgical implements. An oblique bifurcation between the container cover and container bottom, together with a guard forms a cradle within the cover for retaining implements therein, The container is particularly suited for holding syringes within the container cover and accounting for needles, or suture, within the container bottom.

U.S. Pat. No. D376647 (Marsh, et. al., December 1996) describes a sharps box with a ball and socket hinge with side securing latches.

U.S. Pat. No. D273615 (Maskrey, April 1984) describes a vacuum formed sharps box with a living hinge integrally formed during the vacuum forming process.

The art generally prescribes sharps boxes with integrally formed living hinges when complete security is desired for elimination of escape of needles and scalpel blades. Such hinges also eliminate detachable use of the two halves of the sharps box.

SUMMARY OF THE INVENTION

The present invention is an improved two part sharps box. Two snap apart hinges with securing dual-claws are disclosed with box features such as overlap edges and a releasable, heavy duty closure latch. In another embodiment, a scalpel blade unlocker is described improving the safety of a forward-backward removal motion without an enclosing cover. The scalpel blade unlocker is designed with two relatively tall lateral movement blockers which substantially increase the crush strength of the box. The combined effect of the hinges, overlap edges, scalpel unlocker and latch provide a novel and nonobvious sharps box which has superior security with reduced resin requirements for such improved security.

In another embodiment of the hinge of the present invention, a continuous C-shaped hinge is provided instead of a dual claw hinge with a securing lug. The effective equivalent of a securing lug is provided with opposing securing lips along the longitudinal edges of the C-shaped hinge.

It is a critical aspect of the present invention to integrally mold, i.e. effectively attach or impress by melt bonding, the aspects of the present invention to one or the other of the halves of the box of the present invention. Such processes as injection or compression molding, among others, will achieve this object. In a surgical setting, speed and simplicity of operation must combine with relatively few moving parts in necessary equipment to meet each definable step of the procedure. The present invention eliminates for sharps boxes any separate pieces to completely secure and lock a sharps box in a closed position. The operating room or other similarly situated medical personnel can observe and hear in a single closure motion the locking of the latch to a bail completing that locking closure.

The prior art teaches a multitude of devices requiring two or three or more operations to achieve this closure. These prior art devices are effectively ineffective in many situations. The personnel responsible for such securing closure often complete only a single closure motion and fail to complete the additional steps needed for effective locking closure. Thus, medical personnel are routinely exposed to sharps containing boxes that can fly open when dropped on a hard surface, spreading bloody needles and scalpel blades about.

Even routine disposal of these inadequately secured boxes is a hazard. Medical personnel tossing a sharps containing box on other hard objects in a disposal bag may cause the box to spring open or such springing open may occur upon twisting of the top and bottom halves in a disposal bag being pressed down or carried and thrown down on a floor or other hard surface.

The present invention provides an urging open of the box when the releasable latch is disengaged from the bail. The rugged and secure hinge means and the urging open means combine to provide an often needed option to safely and easily re-open a locked-closed sharps box for recounting of the sharps items. The count of sharps items in the sharps box must perfectly correspond with the items used in a surgical procedure to eliminate the possibility of having left an item in the patient.

It is rather easy in the prior art to appear to achieve a simple, secure and safe locking sharps box. Many such patented boxes are currently widely commercially used. Closer inspection shows that achieving easily releasable, secure locking with a simple, single, observable action has in fact not previously been achieved.

The preferred hinges of the present invention, in addition, prevent accidental disengagement of the halves of the box as with the prior art ball and socket type as shown in U.S. Pat. No. D376,647. Although more secure than a ball and socket type hinge, the living hinge widely taught in U.S. Pat. Nos. 5,617,952, 4,886,165, 4,373,629, 4,193,496, and D273,615 prevents detachability of the halves and generally does not allow completely flat opening of the halves without additional downward pressure. A set of disengagable halves of a small sharps box with one or two dual claw hinges is not taught in the prior art for re-engagable operation. The ease of disengagement and re-engagement of the hinges is a critical feature of the hinges of the present invention.

BRIEF DESCRIPTION OF THE DRAWINGS

FIG. 6 is a broken away upward view of the bottom, dual-claw hinged half of the sharps box to show the detail of the dual-claw hinge.

FIG. 7 is a broken away outside view of the top, rotational axis hinge half of the sharps box to show the detail of the rotational axis hinge.

FIG. 8 is a top view of the scalpel blade unlocker.

FIG. 9 is a front view of the scalpel blade unlocker.

FIG. 10 is a cross sectional AA view of the scalpel blade unlocker shown in FIG. 9.

FIG. 11 is the scalpel blade unlocker of FIG. 8 viewed from the side at about a 45 degree angle from horizontal.

FIG. 12 is a broken away section of the top half of the sharps box viewed into that half to show detail of the bail of the latching mechanism on the latching side of the sharps box.

FIG. 13 shows a side view of the non-hinge, non-latch sides of broken away sections of the top and bottom halves of the sharps box to demonstrate the latching action of the latch and bail on latch sides of the top and bottom halves of the sharps box.

FIG. 14 is a section BB shown in FIG. 13 through a vertical midline of the latch and bail to show the latching mechanism in greater detail.

FIG. 15 is substantially the same as that of FIG. 14 except that the slip face and the locking interface of the latch is changed and support ribs for the bail and the latch have been added.

FIG. 16 is substantially the same as that of FIG. 14 except that a portion of the opposing faces of the planar shaft of the latch and the latch side of the top half have raised, complementary, angled faces which urge open the box upon release of the latch from the bail.

FIGS. 17 and 18 are, respectively, bottom and side views of a continuous, single piece C-shaped hinge as an alternative embodiment to the dual claw hinge with a securing lug shown in FIGS. 3–6.

DETAILED DESCRIPTION OF THE INVENTION

The present invention is now shown with reference to the Figures, in which item numbers repeated among the Figures refer to aspects of the Figures with substantially the same structure and function. It is well known, and typically required, that sharps boxes be provided to the industry in one of five standard sizes. Those sizes, as measured by external dimensions, are approximately:

1: 92 mm×120 mm×15 mm

2: 92 mm×120 mm×36 mm

3: 54 mm×114 mm×15 mm

4: 54 mm×114 mm×36 mm

5: 54 mm×76 mm×36 mm

The first measure is the box width (defining the length of the non-hinge sides). The second measure is the box length (defining the length of the hinged sides). The third measure is the box depth. The example below will describe application of the improvements for the present invention for size 3. The improvements of the present invention may require some adaptation between the embodiment for size 3 and the other sizes. Although some adaptation may be needed for different sized boxes, the improvements of the present invention may be applied to such integrally molded boxes with substantial latched together depth (above about 10 mm). Where securing within such boxes small or dangerous objects is required, the aspects of the present invention provide such closure security with a high strength closure means and high resistance to shock opening such as occurs upon dropping the box upon a hard surface.

In view of those objects, the box halves of the present invention are preferably integrally molded of an appropriate polymer, such as polypropylene, polystyrene, polysulfone, polycarbonate, fiber-filled polymer mixtures and the like, although medium impact polystyrene is a preferred polymer for integral molding of the box halves and all the embodiments of the present invention. Materials of construction may comprise flowable materials which will become sufficiently strong to contain the load of the box, but be sufficiently minimally flexible to allow for dual-claw hinge and latch flexion to accomplish, respectively, box half engagement and disengagement and easy and secure latching as described below.

Figure 1:
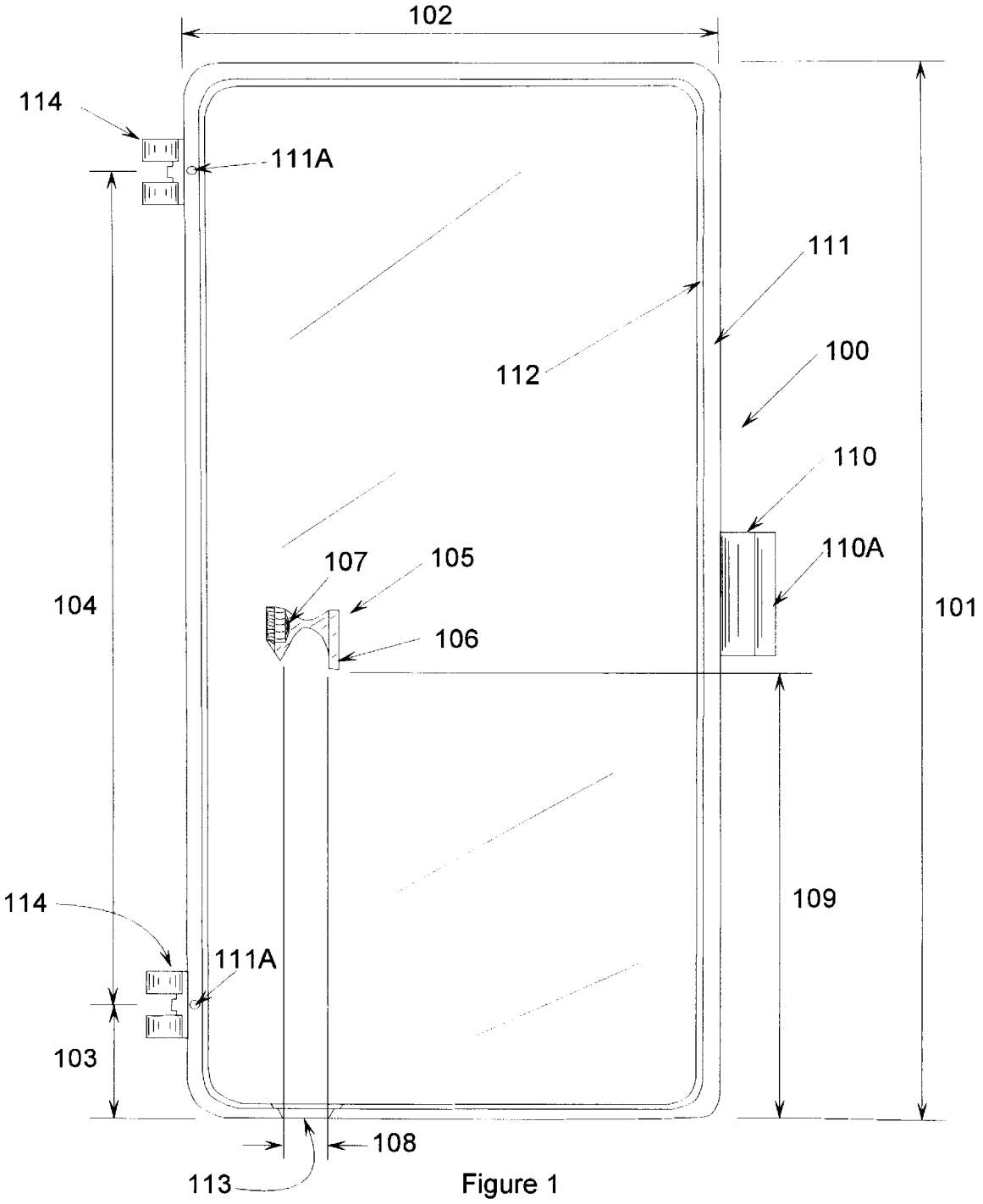
FIG 1. is a top view into the bottom, dual-claw hinged half of the sharps box. A scalpel blade unlocker is situated inside this half of the sharps box aligned with a rectangular notch out in a non-hinge, non-latch edge of the box.

In FIG. 1, bottom half 100 comprises a substantially rectangular box with outside dimensions of length 101 at about 114 mm and length 102 at about 54 mm, with an overall thickness of about 1.5 mm and a outside overlap 111 with a thickness of about 0.75 mm and inside overlap support ledge 112 with a thickness of about 0.75 mm. The longer sides comprise a hinge side and a latch side.

The latch side of bottom half 100 has a latch 110 at about the middle of length 101. Latch 110 is arcuately projected outward from an attachment 110C at the bottom outer edge of bottom half 100, transitioning to a portion extending upwardly and parallel to or slightly angled away from the sidewall of bottom half to substantially above an upper edge of the sidewall of bottom half 100, ending in a bail slip face 110E. From the bail slip face, an outward and downward projecting lip 110A is provided for lockably engaging and securing the halves of the sharps box together. This latch construction, with a planar shaft width of about 10–15 mm and a flexing length of about 15 mm, creates a portion of a highly secure locking mechanism for the sharps box. Attachment 110C may be made to extend from the latch side of the bottom half 100 if the combined closed box depth exceeds the length found most effective for planar shaft 110D. The embodiments of FIGS. 13–16 show extension from a bottom edge as meeting the requirements for a box of minimum combined closed box depth.

Although the combination of the present latching mechanism with the present hinges and overlapping edges makes the sharps box very difficult to open by prying, dropping or compression on the box walls, the holder of the closed sharps box may very easily open the sharps box by deflecting latch 110 toward the sidewall of the sharps box preferably with the thumb, thereby releasing it from engagement with bail 210 as shown in FIG. 13. Such release requires only a single hand of the holder, instead of the prior art devices requiring sometimes two or more motions to unlatch the sharps box, usually requiring actions of both hands.

Figure 3:
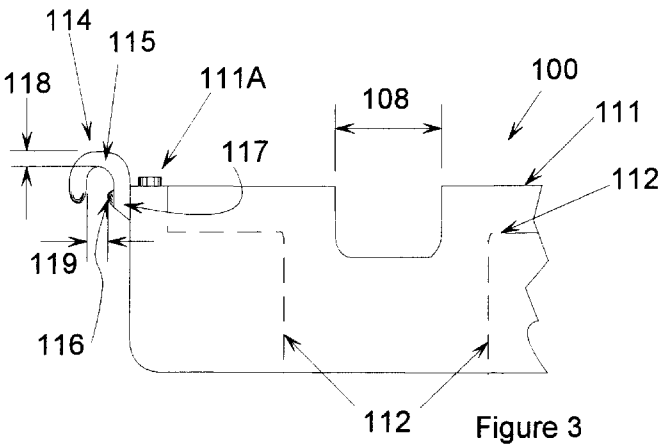
FIG. 3 is a broken away side view of the bottom, dual-claw hinged half of the sharps box.
Figure 2:
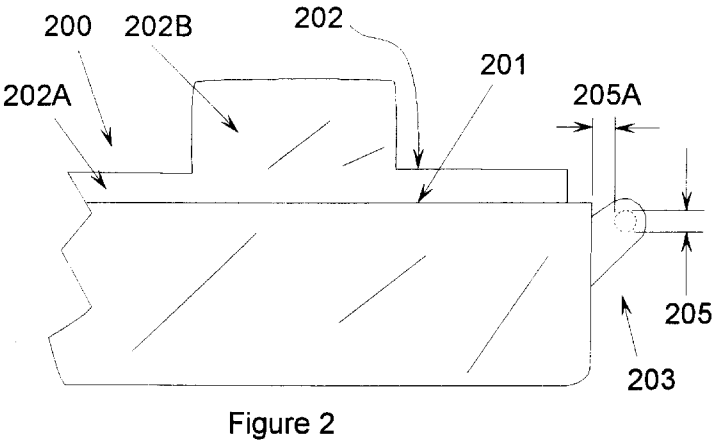
FIG. 2 is a broken away side view of the top, rotational axis hinge half of the sharps box.

In addition, single handed opening of the sharps box is enhanced with location of lugs 111A, as in FIGS. 1 and 3, on the hinge side of the sharps box on an opposing, engaging surface formed at the upper, overlapping edge of bottom half 100. Such lugs 111A on closure of the sharps box cause the lower edge of top half 200 edges of the lugs 111A are small integral extensions of the top rim of overlap 111, preferably located close to the dual claw hinges 114. These lugs 111A urge open the closed halves of the sharps box of the present invention, thus enabling box opening with a single hand with the action of thumb pressure to the latch and immediate thumb manipulation of the halves into a fully open position without transfer of the box to another position on the palm of the opening hand.

Bail 210 is shown in FIG. 12 mounted perpendicular to a latch side sidewall of top half 200, defining latch opening 210B with latch engaging portion 210A distal to the latch side wall of top half 200. This latching means, comprising the latch and the bail, provides that closure of the halves of the sharps box of the present invention gives the personnel closing the sharps box a clear view of the passage of the outwardly projecting lip of latch 110 through the latch opening 210B into a final lockable, securing latching position.

In a the locking, box-closing motion, lip 110A and an upper, outer portion of planar shaft 110D is urged against the outer edge of latch opening 210B (against latch engaging portion 210B), as shown in FIG. 13. FIG. 13 shows broken away sections of bottom half 100 and top half 200 in side view to demonstrate an embodiment of the latching means and method. Latch 110 is secured to bottom half 100 at rounded edge 123, wherein the rounded edge 123 is shown from in a top outside view in FIG. 6. A similar rounded edge 209 is shown in FIG. 7 for top half 200. Such rounded edges provide additional, significant resistance crushing and twisting displacement for the halves of the box.

Dual claw hinges 114 are shown on the hinge side of bottom half 100 at effective detachable length 103, about 12 mm, from the sides of bottom half 100. The present invention comprises hinge means that provide easy detachment and re-attachment for two halves of a compact box only when the box is open more than about 100 degrees, where complete box closure defines a zero degree open position. The relative ratio of lengths 103 and 104 (about 89 mm) comprise a preferred and optimized ratio achieving superior strength with minimal dual claw and hinge pin thickness.

The views of the dual claw hinges 114 are shown in FIGS. 1 and 3–6. The views of the hinge pins 203 which the dual claw hinges engage are shown in FIGS. 2–5 and 7. It must be understood that the top and bottom halves of sharps boxes used in surgery are usually separated. The size of the trays used in surgery are so crowded or otherwise used or reserved for use that there is insufficient space for a box joined at the hinges. The hinge means of the present invention provides far superior secure box closure with improved engagement and disengagement ability at the hinge means. Hinge means include the dual claw hinges and the hinge pins.

First describing in detail the dual claw hinges 114, single claw 115 comprises generally an inverted C-shape with a thickness 118 of about 1 mm and a width 120 of about 2 mm, wherein the two claws are laterally separated by distance 121 of about 2 mm. The C-shape has an internal diameter of about 1.5 mm. Securing lug 116 is fixed between the single claws 115 as an integral extension of the attachment zone defined on the hinge side of the bottom half 100 for the dual claw hinges. Securing lug 116 is about 1.3 mm wide and extends into the side view of the C-shape of the single claws 115, as shown in FIG. 3, such that the diameter 205 of the hinge pin shaft 206 (as shown in FIG. 7) is substantially greater than the securing lug to claw end distance 119. In the present embodiment, distance 119 is about 1 mm and diameter 205 is about 1.5 mm. Ribs 117A extend from the hinge side of bottom half 100 to support the single claws 115 from below.

Hinge pins 203 comprise supports 207 for hinge pin shaft 206. These supports 207 hold hinge pin shaft 206 spaced at distance 205A of about 2 mm from the hinge side of the top half 200 to permit free rotation of single claws 115 while preventing disengagement of the dual claw hinges 114 from the hinge pins 203 at a desired opening relationship as described below.

Figure 4:
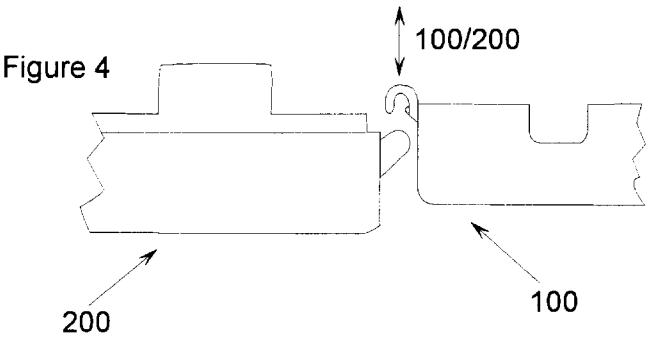
FIG. 4 is an engaging motion view of the sharp box halves of FIGS. 2 and 3.

As shown in FIG. 4, top half 200 is preferably secured so that its outside top face is in a downward facing position. Bottom half 100 is then moved into position above top half 200 such that hinge pin shafts are aligned directly below and parallel with the matching axes formed by the centers of the C-shapes of the single claws 115. When dual claw hinges 114 are pressed downward in direction 100/200, the dual claw hinges 114 and hinge pins become engage as shown in FIG. 5.

Figure 5:
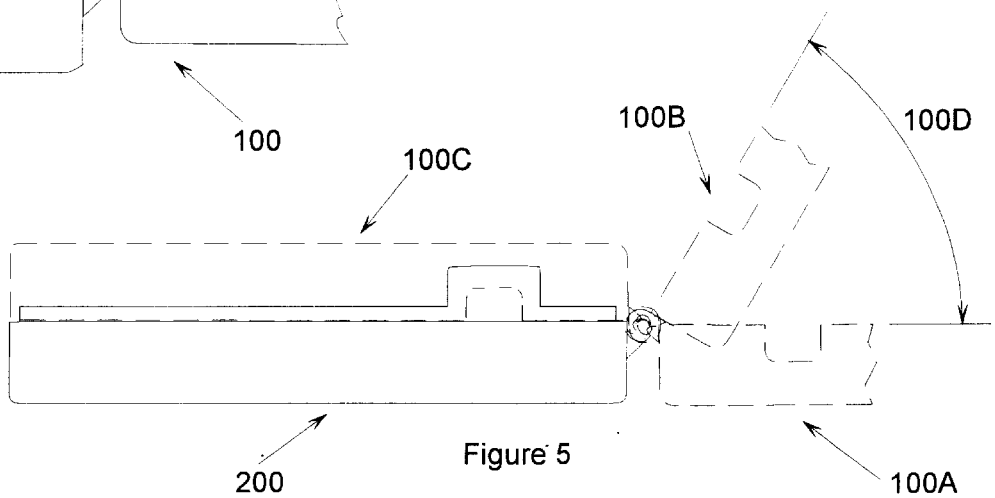
FIG. 5 is a closure motion side view of the top and bottom halves of the sharps box.

It is critical to the present invention with respect to the path traveled as the top and bottom halves are pivoted together when the dual claw hinges and the hinge pins are engaged as shown in FIG. 5, that at some point in that path toward closure it becomes effectively impossible to disengage the dual claw hinges from the hinge pins. For the presently dimensioned embodiment, that point is angle 100D of about 100 degrees from position 100A to 100B in FIG. 5. Beyond that point in the closure path, the outside diameter of the single claws 115 will engage and press against the hinge side of top half 200 such that only by breaking or tearing off the hinges could the top half 200 be disengaged from bottom half 200. In addition to this extremely secure hinge means, when the bottom half is in 100C in a fully closed position, the overlapping relation of the top and bottom halves make lateral movement of the top half with respect to the bottom half effectively very, very difficult. With the addition to the embodiment of FIG. 5 the latching means disclosed below, the combination can be appreciated to comprise the most secure means of providing secure closure with few special extensions of the integrally molded box halves. The devices of the prior art can achieve similar secure closure and disengageable hinging only with significantly more device mass or separately made pieces which must be attached in significantly more steps that simple closure and snap latching as described below.

Disengaging the hinge pin shaft 205 from the dual claw hinge 114 requires in the open position 100A as in FIG. 5 has been made surprisingly easy since simple bending or twisting type pressure to the top and bottom halves only requires the outward bending of one of the single claws 115 at a time. The second single claw 115 of each dual claw hinges will then also with similar pressure release, permitting the disengagement of the top and bottom halves in direction 100/200 of FIG. 4 in the upward direction essentially one single claw 115 at a time. Because of the quadruple pressure needed to disengage all four single claws 115 at one time, accidental disengagement by picking up an opened box by one half in virtually eliminated.

The top and bottom halves preferably have an overlapping relationship along their edges when in the closed and latched position, as shown in FIG. 5. Inner closure face 202 and outer closure face 201 opposingly face inner closure face 112 and outer closure face 111 respectively when the top and bottom halves are in the closed and latched position. Inner overlap 202A extends outward to form notch cover 202B which sealingly closes off notch 113 when the top and bottom halves are in the closed and latched position.

FIGS. 1 and 8–11 show a scalpel blade unlocker 105. Right support 106 is adapted to extend from the floor bottom half 100 to the floor of top half 200 when the box is latched closed. For box sizes 3 and 4, distance 109 locates the scalpel blade unlocker sufficiently close to the middle of the floor of the bottom half to optimize ease of blade unlocking through notch 113 with width 108 while providing crush-resisting support to the top and bottom halves at right support 106.

The latching mechanism of the present invention is shown in FIGS. 1 and 12–15. Bail 210 is integrally molded to top half 200 and latch 110 is integrally molded to bottom half 100. In FIG. 12, bail 210 is shown attached to a vertical latch side of top half 200, forming latch opening 210B between the box attachment side of bail 210 and latch engaging portion 210A. The operation of the latching mechanism is shown in FIG. 13 as bottom half 100 shows that an upper portion of latch 110 deflects inward in direction 110B from the broken line position to the solid line position when top half 200A moves from its broken line position to the solid line position of top half 200B. It can be seen in FIG. 12 that a bail engaging lip of latch 110 slips into a latch/bail interface with a bottom face of latch engaging portion 210A.

In FIG. 14, the latching mechanism of FIG. 13 is shown in greater detail as section BB. Top/bottom half facing edges 112/202 and 111/201 are shown in overlapping relationship as previously described. Latch/bail interface 110/210A comprises the underside of a lip which is an extension of bail slip face 110E. Attachment 110C for the latch is an extension of the rounded bottom edge of bottom half 100 and extends to vertical shaft 110D, the top of which forms bail slip face 110E. Bail slip face 110E contacts a top, outer edge of latch opening when closure of the latch is initiated. Downward pressure of the top half toward the bottom half effects the inward deflection shown in FIG. 13 as bail slip face 110E slides into the latch opening and then snaps into place forming latch/bail interface 110/210A.

A more preferred latch/bail interface 110/210B is shown in FIG. 15. A slight notch is formed in the bottom surface of latch engaging portion 210C to form a close coupling of the underside of the lip extension of a more outwardly rounded bail slip face 110F. This close coupling improves the security of the latching mechanism significantly without requiring noticeably more thumb pressure for release of the latch from the bail.

It can be seen that thumb pressure in the direction of 110B on vertical shaft 110D slides removes latch/bail interface 110/210A or 110/210B. With the tension created with lugs 111A upon closing, the release of the latch from the bail by such thumb pressure permits the top and bottom half to spring slight apart. This aspect of the invention is very important to those who work in a surgical environment in gloves and cannot use a fingernail to initiate box opening. Such personnel often must resort to using a pointed metal object to effect box opening without such a spring action. In a surgical field, any wasted motion such as this interferes with the otherwise highly efficient actions.

Ribs 210D and 110G may optionally, but preferably, be used to reinforce the bail and latch respectively. Because the choice of materials must be made (for this embodiment, polypropylene was used) to obtain easy hand flexure for the latch and dual-claw hinges, for the present embodiment made the bail and latch less stiff than desired. Addition of ribs about 1 mm thick provided a significant improvement in latching mechanism security and stiffness.

For the purposes of effecting this latching mechanism on the latch side of a box, it is not critical that the halves of the box have approximately equal depths, as shown in the Figures. The skilled person will appreciate that a vertical sides distance is defined by the point at which the latch is attached to the bottom edge or vertical latch side of the bottom half of the box and the point at which the bail attaches to the bottom edge or vertical latch side of the top half of the box, and that the closure facing edges of the box halves need only meet within that distance. Thus, a combined top and bottom half depth of a box is not limited by the effective dimensions of the present latching mechanism. One or more of the present latching mechanisms may be combined on a latching side of a box or on the non-hinge sides of a box to effect secure closure of the box. Although it is preferable that the latch attach to and extend from the bottom half of a box for ease in depression and pop-open release of the top half in combination with pop-opening means such as the lugs 111A or slight extension of a right support 106, a reverse configuration is operable to effect closure of a box such that the latch is attached to the top half and the bail is attached to the bottom half.

The same sort of reversal of attachment to the top and bottom halves is appropriate for the dual-claw hinge and hinge pin assembly. Such a reversal from the above embodiment accomplishes optimal use of the hinge means for left handed persons.

In another embodiment of the present invention, FIG. 16 shows a latching means similar to that shown in FIG. 14. The improvement is an alternate means for urging open the halves of the box when thumb or other pressure in direction 110B is applied and lip 110A disengages from latch engaging portion 210A. Extended opposing face 110H extends from the inside face of planar shaft 110D to form a planar or curved face whose plane or tangent planes form an angle with the inside face of the lower portion of planar shaft 110D of less than about 45 degrees. When the box is in the fully closed position, extended opposing face 210H extends outward from the latch side of top half 200 toward face 110H to form a plane substantially parallel to, normal to and slightly spaced from face 110H, as shown in FIG. 16.

Depression of the planar shaft 110D in the embodiment of FIG. 16 forces into sliding contact faces 110H and 210H, forcing the top and bottom halves apart with a force controllable by the personnel opening the box. A greater degree of control over the opening-urging pressure and displacement of the initial box opening is achieved with the means for urging the box open in FIG. 16. It will be appreciated that when faces 110H and 210 H are pressed together as shown in FIG. 16 with the latch disengaged from the bail, the compression force on the faces is substantially non-normal and causes top half 200 to move upward with respect to bottom half 100.

In another embodiment of the present invention, FIGS. 17 and 18 disclose a continuous claw hinge 114A. Although less preferable to the dual claw hinge, hinge 114A comprises a open cylindrical C-shaped claw 115A substantially an axially extended version of the single C-shaped claw 115. It is less preferable to use a single such hinge 115A, as the only hinge means for a sharps box, although some of the objects of the present invention will still be achievable thereby. It is more preferable to provide two hinges 114A as the hinge means of the present invention, each adapted to provide approximately the same hinge pin securing space (although with significantly different operation thereof) as that defined with the two claws of a dual claw hinge 114. However, the present embodiment for a continuous C-shaped hinge preferably also comprises lips 116A and 116B to provide substantial hinge pin securing operation as provided by the securing lug 116 as shown in FIG. 3. The operation of engaging a hinge pin into the open cylindrical space of the C-shaped claw 115A comprises pressing a hinge pin with a diameter greater than distance 119 in FIG. 18 past lips 116A and into that open cylindrical space. The hinge pin thereby is secured into place and prevents the hinges from disengaging unless by two-handed operation by the box handler.

I claim:

1. A box comprising:

(a) a top half and a bottom half adapted to be brought together to a closed position, each half comprising:

(i) hinge and latch sidewalls parallel and opposite to each other and, with other sidewalls, continuously molded to a floor such that when the halves are in a closed position the floors have a closed depth of about more than about 10 mm;

(ii) a facing edge comprising open edges of the sidewalls, such facing edges adapted to contact the facing edge of the other box half and securely enclose contents of the box when the box is in the closed position;

(iii) an outside of the hinge sidewall from which extend two complementary halves of two separate hinges, whereby each complementary hinge half is adapted to disengageably hinge with the opposing hinge half of the other box half; and (iv) an outside of the latch sidewall from which extends a single complementary portion of latching means for releaseably latching the box halves together;

(b) the portion of the latching means for the bottom half, when its floor is horizontal, comprising a latch shaft extending away and then upward from the outside of the latch sidewall to substantially above the facing edge of the bottom half and adapted to have a length such that finger depression on an outside of the latch shaft below the complementary latch half of the top half when the hinge halves are in a latched position will release the latch halves from the latched position;

(c) the portion of the latching means for the top half comprising a bail comprising two supports extending from the outside of the latch sidewall, the ends of the supports connected by a latch engaging portion, the combination of the supports and latch engaging portion forming a latch opening and the latch engaging portion having an underside and a topside;

(d) the latch shaft ending in a bail slip face that extends downward and away from the latch shaft to form a lip with an underside, the bail slip face adapted to, during the action of bringing the box halves into the latched position, slide against an underside of the latch engaging portion and through the latch opening until a lip edge passes the topside of the latch engaging portion such that the lip is urged into a position opposed to the topside of the latch engaging portion into the latched position; and (e) at least one box half further comprises box opening initiating means, adapted to urge the box open when the box halves are released from the latched position, wherein box opening initiating means comprises an upward support extending from a scalpel blade remover located about in the middle of an inside floor of the bottom half, the extension having a length slightly longer than a closed inside diameter of a closed box.

2. A box comprising a continuously molded top half and a separate continuously molded bottom half, the box halves in a closed position having a closed depth of about more than about 10 mm, whereby each box half is adapted to comprise a facing edge which contacts a facing edge of the other half in a closed position and thereby securely enclose contents of the box when in that closed position, each box half further comprising an outside of a hinge sidewall from which extend two separate complementary halves of two separate hinges, whereby each complementary hinge half is adapted to disengageably hinge with the opposing hinge half of the other box half comprising:

(a) on a first box half, each of the two separate complementary hinge halves having two C-shaped single claws attached at one end of their C-shapes to the outside of the hinge sidewall, such that an axis through the centers of the C-shapes lies substantially parallel to a length of the hinge sidewall, wherein each pair of C-shaped single claws are spaced apart sufficiently to have a securing lug extend from the outside of the hinge sidewall toward the axis of the centers of the pair of C-shaped single claws, such extension of the securing lug being adapted to easily disengageably secure a hinge pin shaft within a hinge pin shaft receiving zone along the axis of the centers of the pair of C-shaped single claws; and (b) on a second box half, each of the two separate complementary hinge halves having a hinge pin shaft held out by two attachment arms away from the outside of the hinge sidewall, each hinge pin shaft being secured in disengageable relationship to opposing pairs of C-shaped single claws on the first box half such that the first box half may be rotated about at least 180 degrees about the axis of the centers of the pair of C-shaped single claws from a closed to an open position.

3. The box of claim 2 wherein, in a closure path from an open position to a closed position of the box halves about the axis of the centers of the pairs of C-shaped single claws, the halves of the box are substantially non-disengageable at a point between the open and closed position due to impingement of an outside diameter face of the C-shaped single claws against the outside of the hinged sidewall of the second box half.

4. The box of claim 2 wherein each box half further comprises a latch sidewall from which extends on its outside a single complementary portion of latching means for releasably latching the box halves together;

(c) the portion of the latching means for the bottom half, when its floor is horizontal, comprising a latch shaft extending away and then upward from the outside of the latch sidewall to substantially above the facing edge of the bottom half and adapted to have a length such that finger depression on an outside of the latch shaft below the complementary latch half of the top half when the hinge halves are in a latched position will release the latch halves from the latched position;

(d) the portion of the latching means for the top half comprising a bail comprising two supports extending from the outside of the latch sidewall, the ends of the supports connected by a latch engaging portion, the combination of the supports and latch engaging portion forming a latch opening and the latch engaging portion having an underside and a topside;

(e) the latch shaft ending in a bail slip face that extends downward and away from the latch shaft to form a lip with an underside, the bail slip face adapted to, during the action of bringing the box halves into the latched position, slide against an underside of the latch engaging portion and through the latch opening until a lip edge passes the topside of the latch engaging portion such that the lip is urged into a position opposed to the topside of the latch engaging portion into the latched position.

* * * * *